US005266186A

United States Patent [19]

Kaplan

[11] Patent Number: 5,266,186

[45] Date of Patent: Nov. 30, 1993

[54] INHIBITING FOULING EMPLOYING A DISPERSANT

[75] Inventor: Morris Kaplan, Houston, Tex.

[73] Assignee: Nalco Chemical Company, Naperville, Ill.

[21] Appl. No.: 625,959

[22] Filed: Dec. 11, 1990

Related U.S. Application Data

[63] Continuation of Ser. No. 420,778, Oct. 12, 1989, abandoned.

[51] Int. Cl.[5] ..... C10G 9/16

[52] U.S. Cl. ..... 208/48 AA; 208/48 R; 208/47; 585/950; 44/331

[58] Field of Search ..... 208/47, 48 AA; 44/62, 44/71, 73; 585/950

[56] References Cited

U.S. PATENT DOCUMENTS

| | | | |
|---|---|---|---|
| 2,993,771 | 7/1961 | Stromberg | 208/48 AA |
| 3,172,892 | 3/1965 | La Suer | 208/48 AA |
| 3,325,484 | 2/1966 | Colfer | 208/48 |
| 3,271,295 | 9/1966 | Gonzalez | 208/48 AA |
| 3,329,658 | 4/1967 | Fields | 44/346 |
| 3,379,515 | 4/1968 | Lindstrom | 44/62 |
| 3,380,909 | 4/1968 | Lee . | |
| 3,382,056 | 5/1968 | Mehmedbasich | 44/62 |
| 3,449,250 | 6/1969 | Fields | 44/62 |
| 3,560,455 | 2/1971 | Hazen . | |
| 3,578,421 | 5/1971 | Andress et al. | 44/62 |
| 3,666,656 | 5/1972 | Stanley . | |
| 3,985,504 | 10/1976 | Kindescher et al. | 208/47 |
| 4,200,518 | 4/1980 | Mulvany . | |
| 4,234,435 | 11/1980 | Memhardt et al. | 252/475 |
| 4,240,916 | 12/1980 | Rossi | 252/56 R |
| 4,265,711 | 5/1981 | Gleim | 208/48 AA |
| 4,419,105 | 12/1983 | Sung | 208/47 |
| 4,511,369 | 4/1985 | Denis et al. | 94/346 |
| 4,533,482 | 8/1985 | Bullinejer | 252/56 R |
| 5,017,299 | 5/1991 | Coutieriez et al. | 252/51 R |
| 5,068,047 | 4/1991 | Chung et al. | 252/565 R |

FOREIGN PATENT DOCUMENTS

| | | | |
|---|---|---|---|
| 3237109 | 4/1984 | Fed. Rep. of Germany | 208/47 |

*Primary Examiner*—Helane Myers
*Attorney, Agent, or Firm*—Arnold, White & Durkee

[57] ABSTRACT

The present invention provides a method for inhibiting fouling deposits in refinery processing equipment caused by the heat treatment of hydrocarbon feedstocks. The deposits are inhibited by adding to the feedstock an effective amount of an iron sulfide dispersant prepared in accordance with this invention. The dispersants comprise polyimides which are prepared by reacting fatty amines with maleic anhydride/alpha-olefin copolymers.

16 Claims, No Drawings

INHIBITING FOULING EMPLOYING A DISPERSANT

This is a continuation of application Ser. No. 420,778, filed Oct. 12, 1989, now abandoned.

The present invention relates to anti-fouling agents for hydrotreating hydrocarbon products or feedstocks.

BACKGROUND OF THE INVENTION

Hydrotreating is a process to catalytically stabilize petroleum products and/or remove undesirable substances from hydrocarbon products or feedstocks by reacting them with hydrogen. Suitable hydrocarbon feedstocks vary widely from naphtha to reduced crude oils. The objectives of hydrotreating include (1) converting unsaturated hydrocarbons to saturated hydrocarbons (for example, olefins and diolefins to paraffins) and (2) removing undesirable substances such as sulfur, nitrogen, oxygen, halides and trace metals from the feedstock.

Generally in hydrotreating processes, the hydrocarbon feedstock is mixed with hydrogen-rich gas either before or after the feedstock is preheated to the proper temperature. The feedstock is typically preheated from about 500° F. to about 800° F. The feedstock enters a reactor in the presence of a metal-oxide catalyst. The hydrogen reacts with the feedstock to form hydrogen sulfide, ammonia, saturated hydrocarbons and free metals. The metals remain on the surface of the catalyst and the other products leave the reactor with the hydrocarbon-hydrogen stream. The hydrocarbon-hydrogen stream then enters a separator to separate the hydrocarbon from the hydrogen-rich gas. The hydrocarbon is stripped of any remaining hydrogen sulfide and "light ends" in a stripper. The gas stream is treated to remove hydrogen sulfide.

As described above, refinery processes (such as separating and converting) typically involve preheating of the hydrocarbon feedstocks. Preheating is normally accomplished by using heat exchangers in which a series of metal tubes carrying the hydrocarbon are encased in a second tube which carries a hot stream. The heat from the stream is conducted through the tubes to the hydrocarbon feedstock which is then carried to the next stage of processing. The hydrocarbon feedstocks, which may be unrefined or partially refined, are generally preheated to temperatures in the range of about 300° F. to about 1,600° F. The specific preheated temperature will depend upon the temperature and physical phase requirements of further processing.

One of the major problems encountered during hydrocarbon processing, and particularly in heating equipment, is fouling. The term "fouling" as used herein refers to the formation of deposits on the metal surfaces of processing equipment. Fouling deposits most frequently occur at elevated temperatures and vary in composition as organic, inorganic, or mixed organic and inorganic deposits. The organic deposits are primarily insoluble, high molecular weight, polymerization products. The inorganic deposits frequently contain silica, iron oxide, iron sulfide, alkaline earth metal oxides, and various metal salts. Inorganic portions are believed to result from ash components of the crude oil, corrosion products from the metal surfaces that the feedstock contacts, and contaminants from the various metallic catalysts used in processing.

The efficiency of processing equipment is materially decreased when fouling occurs. The direct results of fouling appear in the form of heat transfer loss, increased pressure drop between the heat exchanger equipment inlet and outlet, and loss in-throughput. When fouling deposits accumulate, the equipment sometimes must be disassembled and mechanically and/or chemically cleaned to remove the deposits, or in extreme cases, the equipment must be completely replaced. Consequently, the processing units must be shut down, resulting in lost production.

Fouling deposits from hydrotreater units often contain substantial amounts of iron sulfide. The iron sulfide deposits originate from active corrosion in wellbores, pipelines, or crude oil storage facilities. Particulate iron sulfide entrained in the hydrocarbon precipitates in the hydrocarbon/effluent exchanges. The iron sulfide is believed to act as a deposit binder, thereby increasing the fouling rate. If the deposition of iron sulfide can be inhibited, fouling will be reduced significantly. This is readily accomplished by use of the dispersant antifoulants described in the present invention.

SUMMARY OF THE INVENTION

The present invention provides a method for inhibiting fouling deposits in refinery processing equipment caused by the heat treatment of hydrocarbon feedstocks. The deposits are inhibited by adding to the feedstock an effective amount of an iron sulfide dispersant prepared in accordance with this invention. The dispersants comprise polyimides which are prepared by reacting fatty amines with maleic anhydride/alpha-olefin copolymers.

DETAILED DESCRIPTION

The present invention provides a method for inhibiting the formation of fouling deposits in refinery or petrochemical processing equipment by utilizing iron sulfide dispersants. The polyimide dispersants are prepared by reacting fatty amines with maleic anhydride/alpha-olefin copolymers.

The materials useful in the present invention comprise copolymers of primarily straight chain alpha-olefins and maleic anhydride. The oil-soluble copolymers have number average molecular weights in the range of about 3,000 to about 30,000. The preferred molecular weight of the copolymers is about 6,000 to about 15,000.

The preferred alpha-olefins have a range of about 10 to 36 carbon atoms. Suitable sources for the straight chain alpha-olefins are commercial olefin fractions such as $C_{10}$ to $C_{18}$, $C_{20}$ to $C_{24}$, and $C_{24}$ to $C_{28}$ alpha-olefins. Alternatively, the individual alpha-olefins, such as 1-octene, 2-methyl-1-heptene, 1-decene, 1-dodecene, 1-tridecene, 1-undecene, 1-eicosene, 2-methyl-1-eicosene, 1-docene, and 1-tetracosene can be used in preparing the copolymers. Mixtures of alpha-olefins can also be employed. The $C_8$ to $C_{14}$ lower olefins can be branched; however, straight chain alpha-olefins are preferred. The most preferred alpha-olefin for use in the present invention is a commercially available $C_{24}$–$C_{28}$ alpha-olefin fraction.

Maleic anhydride/alpha-olefin copolymers and methods of their preparation are well known in the art. See, for example, U.S. Pat. Nos. 3,560,455 and 4,240,916, which are incorporated by reference. For the copolymers useful in the present invention, maleic anhydride may be reacted with the alpha-olefin in a ratio of about 0.8 mole up to about 1.4 moles maleic anhydride per 1 mole alpha-olefin. The preferred ratios of maleic anhydride to alpha-olefin are in the range of about 0.9:1 to about 1.2:1. The most preferred mole ratio is 1 mole maleic anhydride to i mole alpha-olefin. The copolymers useful in the present invention are prepared at elevated temperatures from about 150° C. to about 170° C. centigrade under nitrogen atmosphere. The polymerization reaction is initiated by a suitable catalyst, which includes peroxide catalysts, such as di-t-butylperoxide.

The effective iron sulfide dispersants of the present invention are formed by reacting the maleic anhydride/alpha-olefin copolymers described above with an amine at a temperature of about 145° C. to about 195° C. The preferred amines include fatty amines, ethylenediamine, tertiary-alkyl primary amines, methoxypropylamine, and hexamethylene diamine. The most preferred amines are fatty amines having 8 to 22 carbon atoms, such as cocoamine and tallowamine. The amines are reacted with the copolymer in a mole ratio of about 1:1 to about 1:2. The preferred ratio is about 1 mole amine to 1 mole copolymer.

The reaction product of the copolymer and the amine is the concentrated active ingredient of the antifoulant dispersants of the present invention. The reaction product is too viscous to be easily pumped, so the product is diluted with a solvent for easy handling. Preferred solvents include naphtha, kerosene, and toulene. The solvent is normally added in an amount of about 40% to about 85% by volume. The preferred amount of solvent is in the range of about 40% to about 60%.

The dispersant antifoulants of the present invention are substantially more effective at dispersing iron sulfide than existing commercial products. The effective concentrations range from as little as 1 part per million to about 2,000 parts per million (i.e., parts per million based on the hydrocarbon feedstock). The optimun treating concentration is dependent on the type of hydrocarbon feedstock, the type of refining operation to which the feedstock is subjected, and the temperature at which the particular process is performed. Generally, the preferred concentration of dispersant antifoulant is in the range of about 5 to 50 parts per million.

The dispersant antifoulants of this invention may be added to the hydrocarbon feedstock at any point in the process to be protected from fouling. The iron sulfide dispersants may be combined with other treating additives for the hydrocarbons, such as gum dispersants, antioxidants, anti-polymerants, metal deactivators, corrosion inhibitors, and the like.

The following examples are given to further illustrate the present invention, but are not intended to limit the invention in any way.

EXAMPLE 1

To test the effectiveness of the antifoulant dispersants, methods in accordance with the invention described herein were adapted to a pass/fail test system. Dispersants were prepared and added to hexane sparged with hydrogen sulfide. Ferric naphthenate was added to the hexane at 1,500 ppm. If the iron sulfide remainded dispersed in the liquid, a pass rating was given to the dispersant. If the iron sulfide precipitated, a fail rating was given to the dispersants. Under the test conditions used, a minimum dosage of dispersant was necessary to prevent iron sulfide precipitation. Below the minimum or "pass" dosage, the iron sulfide precipitated.

Dispersants were prepared by reacting 1 mole of a maleic anhydride/alpha-olefin copolymer with 1 mole of the amines listed in Table 1. The copolymer was prepared by reacting 1 mole of commercially available $C_{24}$–$C_{28}$ alpha-olefin with 1 mole of maleic anhydride. The reaction product was diluted with an aromatic solvent to an activity of about 4% to about 5%. The products were evaluated in the pass/fail sulfide dispersant test, and the results shown in Table 1 demonstrate the effectiveness of the antifoulant dispersants.

TABLE 1

| Experiment No. | Amine | Pass Dosage Parts Per Million |
|---|---|---|
| 1(1) | Primene 81-R(2) | 600 |
| 2 | Methoxypropylamine | 700 |
| 3 | Cocamine | 400 |
| 4 | Tallowamine | 400 |
| 5(3) | Commerical Product | 800 |
| 6 | Commerical Product | 700 |
| 7 | Commerical Product | 900 |
| 8 | Commerical Product | 1,200 |
| 9 | Commerical Product | 1,400 |

(1)Experiment Nos. 1–4: Products prepared by reacting 1 mole of $C_{24}$–$C_{28}$ alpha-olefin/maleic anhydride copolymer with amines listed.
(2)Primene 81-R is reported to be composed of principally tertiary-alkyl primary amines having 11–14 carbons and a molecular weight in the range of 171 to 213.
(3)Experiment Nos. 5–9: Composition Unknown.

EXAMPLE 2

Effective dispersants useful in the present invention are also formed by reacting a polyisobutenyl-succinic anhydride adduct with ethylenediamine, followed by further reaction with a maleic anhydride/alpha-olefin copolymer. After reacting 1 mole of adduct with 1 mole of ethylenediamine, a free primary amine group is available for further reaction with the additional mole of copolymer.

In the experiments described in Table 2, a polyisobutenyl-succinic anhydride adduct was prepared and reacted with ethylenediamine. This product was then further reacted in a 1 to 1 mole ratio with a $C_{24}$ to $C_{28}$ alpha-olefin/maleic anhydride copolymer, with the exception of experiment No. 6 in which a $C_{10}$ to $C_{18}$ alpha olefin/maleic anhydride copolymer was used. The reaction products were diluted with an aromatic solvent to the activity listed in Table 2.

The products were tested in the pass/fail dispersant test as described in Example 1. The concentration of dispersant required to keep the iron sulfide dispersed is shown in Table 2.

TABLE 2

| Experiment No. | Activity % | MA:PIB(1) | Pass Dosage Parts Per Million |
|---|---|---|---|
| 1 | 4.5 | 0.9:1 | 1,000 |
| 2 | 2.3 | 1.2:1 | 1,200 |
| 3 | 4.5 | 1.2:1 | 500 |
| 4 | 3.9 | 1.2:1 | 800 |
| 5 | 4.7 | 1.2:1 | 900 |
| 6(2) | 4.5 | 0.9:1 | 1,600 |

(1)Mole ratio of maleic anhydride and polyisobutenyl succinic anhydride.
Experiments 1, 3, 6 - PIB Number Average MW = 1290
Experiment 2 - PIB Number Average MW = 2060
Experiment 4 - PIB Number Average MW = 920
Experiment 5 - PIB Number Average MW = 750
(2)Further reacted with $C_{10}$ to $C_{18}$ alpha-olefin/maleic anhydride copolymer.

What is claimed is:

1. A method for inhibiting the formation of deposits in equipment used in hydrocarbon processing which comprises adding to the hydrocarbon stream an effective amount of a dispersant to inhibit deposition of iron sulfide, said dispersant consisting essentially of the reaction product of a maleic anhydride/alpha-olefin copolymer and an amine, wherein the maleic anhydride/alpha-olefin copolymer is formed in the presence of a catalyst.

2. The method of claim 1 wherein said maleic anhydride/alpha-olefin copolymer comprises the reaction product of maleic anhydride and an alpha-olefin having from 10 to 36 carbon atoms.

3. The method of claim 2 wherein said maleic anhydride and said alpha-olefin are present in a mole ratio of about 0.8:1 to about 1.2:1.

4. The method of claim 1 wherein said amine in the range is selected from the group comprising ethylenediamine, fatty amines, methoxypropylamine, hexamethylene diamine, and tertiary-alkyl primary amines.

5. The method of claim 1 wherein said maleic anhydride/alpha-olefin copolymer is reacted with said amine in a mole ratio in the range of about 1:1 to about 2:1.

6. The method of claim 1 wherein said reaction product is added to said hydrocarbon stream in the amount of about 1 to about 2,000 parts per million based on said hydrocarbon.

7. A method for inhibiting the formation of fouling deposits in equipment used in crude hydrocarbon processing which comprises adding to the crude hydrocarbon stream an effective amount of a dispersant to inhibit deposition of iron sulfide, said dispersant consisting essentially of the reaction product of a maleic anhydride/alpha-olefin copolymer and an amine selected from the group comprising fatty amines, ethylenediamine, hexamethylene diamine, methoxypropylamine, and tertiary-alkyl primary amines, wherein the maleic anhydride/alpha-olefin copolymer is formed in the presence of a catalyst.

8. The method of claim 7 wherein said maleic anhydride and said alpha-olefin are present in a mole ratio of about 0.8:1 to about 1.2:1.

9. The method of claim 7 wherein said reaction product is added to said hydrocarbon stream in the amount of about 1 part to about 2,000 parts per million based on said hydrocarbon.

10. A method for inhibiting the formation of fouling deposits in equipment used in crude hydrocarbon processing which comprises adding to the crude hydrocarbon stream an effective amount of a dispersant to inhibit deposition of iron sulfide, said dispersant consisting essentially of the reaction product of a maleic anhydride/alpha-olefin copolymer and a fatty amine, wherein the maleic anhydride/alpha-olefin copolymer is formed in the presence of a catalyst.

11. The method of claim 10 wherein said copolymer and said amine are reacted in a mole ratio in the range of about 1:1 to about 2:1.

12. The method of claim 10 wherein said reaction product is added to said hydrocarbon stream in the amount of about 1 part to about 2,000 parts per million based on said hydrocarbon.

13. A method for inhibiting the formation of fouling deposits in equipment used in crude hydrocarbon processing which comprises adding to the crude hydrocarbon stream an effective amount of a dispersant to inhibit the deposition of iron sulfide, said dispersant consisting essentially of the reaction product of a polyisobutenyl succinic anhydride adduct and ethylenediamine, followed by reaction with a maleic anhydride/alpha-olefin copolymer which is formed in the presence of a catalyst.

14. The method of claim 13 wherein said polyisobutenyl succinic anhydride adduct has a number average molecular weight in the range from about 750 to about 2,250.

15. The method of claim 13 wherein said reaction product is formed by reacting said polyisobutenyl succinic anhydride adduct with said amine in a mole ratio in the range of about 1:1 to about 2:1.

16. The method of claim 13 wherein said polyamine is ethylenediamine.

* * * * *